US007332053B2

(12) United States Patent
Palsson et al.

(10) Patent No.: US 7,332,053 B2
(45) Date of Patent: Feb. 19, 2008

(54) PROCESS FOR SEALING OF A JOINT

(75) Inventors: Jorgen Palsson, Landskrona (SE); Ake Sjöberg, Lund (SE)

(73) Assignee: Pergo (Europe) AB, Trelleborg (SE)

( * ) Notice: Subject to any disclaimer, the term of this patent is extended or adjusted under 35 U.S.C. 154(b) by 349 days.

(21) Appl. No.: 10/242,674

(22) Filed: Sep. 13, 2002

(65) Prior Publication Data

US 2003/0066588 A1 Apr. 10, 2003

Related U.S. Application Data

(63) Continuation-in-part of application No. 09/988,014, filed on Nov. 16, 2001, now abandoned, and a continuation-in-part of application No. 09/672,076, filed on Sep. 29, 2000, now Pat. No. 6,591,568.

(30) Foreign Application Priority Data

Mar. 31, 2000 (SE) ..... 0001149

(51) Int. Cl.
*C09J 5/00* (2006.01)

(52) U.S. Cl. ..... 156/305; 156/91; 156/293; 52/746.1

(58) Field of Classification Search ..... 156/71, 156/91, 283, 285, 293, 305, 331.6, 93; 52/390, 52/391, 392, 746.1, 746.12, 582.1, 589.1
See application file for complete search history.

(56) References Cited

U.S. PATENT DOCUMENTS 2,004,193 A 6/1935 Cherry
2,088,405 A * 7/1937 Cahn ..... 156/236
2,405,602 A * 8/1946 Nugent ..... 156/64
2,740,167 A 4/1956 Rowley
3,257,225 A * 6/1966 Marotta et al. ..... 427/202
3,479,784 A 11/1969 Massagli
3,496,119 A * 2/1970 Fitzgerald et al. ..... 427/386
3,553,919 A 1/1971 Omholt
3,720,027 A 3/1973 Christensen (Continued)

FOREIGN PATENT DOCUMENTS

CA 991373 6/1976

(Continued)

OTHER PUBLICATIONS

English abstract of JP 02285145.*

(Continued)

*Primary Examiner*—John L. Goff
(74) *Attorney, Agent, or Firm*—Stevens, Davis, Miller & Mosher, LLP

(57) ABSTRACT

A process for installation of surface elements (1), the surface elements (1) comprising a core, a decorative upper surface (3) and edges (2) provided with joining means for mechanically locking the surface elements (1) together. Predetermined portions of the edges (2) are provided with a glue which is present on the edges (2) of the surface elements (1) in a passive dry form and which may be activated by applying a liquid. The surface elements (1) are joined to each other by use of the joining means wherein a unit of a plurality of surface elements (1) is formed.

9 Claims, 2 Drawing Sheets

U.S. PATENT DOCUMENTS

| | | | | |
|---|---|---|---|---|
| 3,798,111 | A | 3/1974 | Lane et al. | |
| 3,807,113 | A | 4/1974 | Turner | |
| 3,859,000 | A | 1/1975 | Webster | |
| 3,921,312 | A | 11/1975 | Fuller | |
| 4,426,820 | A | 1/1984 | Terbrack et al. | |
| 4,449,346 | A | 5/1984 | Tremblay | |
| 4,844,972 | A * | 7/1989 | Tedeschi et al. | 442/41 |
| 4,940,503 | A | 7/1990 | Lindgren et al. | |
| 5,148,850 | A | 9/1992 | Urbanick | |
| 5,216,861 | A | 6/1993 | Meyerson | |
| 5,295,341 | A | 3/1994 | Kajiwara | |
| 5,325,649 | A | 7/1994 | Kajiwara | |
| 5,344,700 | A | 9/1994 | McGath et al. | |
| 5,348,778 | A | 9/1994 | Knipp et al. | |
| 5,502,939 | A | 4/1996 | Zadok et al. | |
| 5,630,304 | A | 5/1997 | Austin | |
| 5,706,621 | A | 1/1998 | Pervan | |
| 5,797,237 | A | 8/1998 | Finkell, Jr. | |
| 5,860,267 | A | 1/1999 | Pervan | |
| 5,907,934 | A | 6/1999 | Austin | |
| 6,006,486 | A | 12/1999 | Moriau et al. | |
| 6,023,907 | A | 2/2000 | Pervan | |
| 6,094,882 | A | 8/2000 | Pervan | |
| 6,101,778 | A | 8/2000 | Martensson | |
| 6,182,410 | B1 | 2/2001 | Pervan | |
| 6,205,639 | B1 | 3/2001 | Pervan | |
| 6,209,278 | B1 | 4/2001 | Tychsen | |
| 6,216,409 | B1 | 4/2001 | Roy et al. | |
| 6,314,701 | B1 | 11/2001 | Meyerson | |
| 6,324,803 | B1 | 12/2001 | Pervan | |
| 6,397,547 | B1 | 6/2002 | Martensson | |
| 6,418,683 | B1 | 7/2002 | Martensson et al. | |
| 6,421,970 | B1 | 7/2002 | Martensson et al. | |
| 6,438,919 | B1 | 8/2002 | Knauseder | |
| 2002/0046526 | A1 * | 4/2002 | Knauseder | 52/581 |

FOREIGN PATENT DOCUMENTS

| | | | |
|---|---|---|---|
| JP | 02285145 A | * | 11/1990 |
| WO | 9966151 | | 12/1999 |
| WO | 0063510 | | 10/2000 |

OTHER PUBLICATIONS

WO 98/58142 Dec. 1998 Knauseder.*
Pending U.S. Appl. No. 09/672,077, filed Jul. 29, 2000.
Pending U.S. Appl. No. 09/988,014, filed Nov. 16, 2001.
Pending U.S. Appl. No. 09/770,395, filed Jan. 29, 2001.
Pending U.S. Appl. No. 10/158,945, filed Jun. 3, 2002.
Pending U.S. Appl. No. 09/672,076, filed Jul. 29, 2000.

* cited by examiner

PROCESS FOR SEALING OF A JOINT

This application is a continuation-in-part application of U.S. patent application Ser. 09/988,014 (now abandoned), filed Nov. 16, 2001, and a continuation-in-part application of U.S. patent application Ser. 09/672,076 (now U.S. Pat. No. 6,591,568), filed Sep. 29, 2000, claiming priority of Swedish Application No. 0001149-4, filed Mar. 31, 2000; the entire disclosures of which are incorporated hereby by reference in their entirety.

FIELD OF INVENTION

The present invention relates to sealing of a joint comprising mechanical locking.

DESCRIPTION OF THE RELATED ART

Prefabricated surface elements which at their edges are provided with groove and tenon are well known nowadays. As these are very easy to install it is possible for the normal handy man to achieve this. Such elements can be constituted of massive wood, fibre board or particle board. These are often provided with a surface layer, such as lacquer or some sort of laminate. The boards are most often installed by gluing them together via their groove and tenon. It is desired to join the separate elements so closely that the joint becomes practically invisible, which increases the moisture resistance radically. The usable life of the installed elements are hereby also increased. It is essential that glue is used excessively in order to achieve a tight joint. Any gaps will lead to that moisture may penetrate the joint with subsequent swelling of the core material closest to the joint. The glue do also have to be used to an amount that it is spill out trough the joint on the decorative side of the surface elements. The superflous glue will of course have to be wiped off before beginning to set, which is rather time consuming.

One way of solving the problem is available on the market for some time now through different types of so-called click or snap-lock floor boards where no glue is to be used. The installation of such floor boards has become much swifter as no glue is required. The problems with these type of surface elements are that relativelly small spills of fluids like water may cause great damage on the installed surface elements as well as subwalls and especially subfloors as the fluid will run through the joints rather rapidly due to the capillary effect. It is, of course, possible to use glue on these snap-lock type of elements as well although the problem with the time consuming cleaning during installation would remain.

SUMMARY OF THE INVENTION

It has, through the present invention, been made possible to solve the above mentioned problems so that self sealing surface elements can be achieved. Accordingly the invention relates to a process for installation of surface elements. The surface elements comprising a core, a decorative upper surface and edges provided with joining means for mechanically locking the surface elements together. The invention is characterised in that predetermined portions of the edges are provided with a glue which is present on the edges of the surface elements in a passive dry form and which may be activated by applying a liquid. The surface elements are hereby joined to each other by use of the joining means wherein a unit of a plurality of surface element is formed. The glue is suitably a PVA glue. The glue is suitably applied on the edges as an emulsion which then is allowed to dry before the joining of the surface elements. The liquid used for reactivating the glue is suitably water. The water is advantageously mixed with alcohol since this reduces the surface tension of the liquid as well as the evaporation rate increases. A thin coat of the liquid is suitably applied on the installed surface elements wherein small amounts of the liquid will pentetrate into the joints thereby moisturising and activating the glue. The glue will hereby expand and merge over the edges of the joint and will act as sealant against further penetration of liquid. It is not necessary to activelly activate the glue by applying the liquid over the installed surface elements as small amounts of liquid accidently spilt on the installed surface elements will pentetrate into the joints thereby moisturising and activating the glue so that the glue expands and merges over the edges of the joint thereby acting as a sealant against further penetration of liquid.

DESCRIPTION OF THE PREFERRED EMBODIMENTS

According to one embodiment of the invention the joining means comprises lower joining lips at two adjacent edges while the two remaining edges are provided with upper joining lips. The lower joining lips are provided with intrinsically vertical lower lip surfaces arranged parallel to the closest edge. The lower lip surfaces are adapted to interact with mainly vertical upper lip surfaces arranged on the upper joining lips so that two joined adjacent surface elements are locked together in a horizontal direction. The joining lips are furthermore are provided with at least one heel adapted to snap join with recesses which, by being provided with intrinsically horizontal locking surfaces, limits vertical movement between two joined adjacent surface elements. The surface elements are hereby assembled by being pressed downwards once the edges are vertically aligned.

According to another embodiment of the invention the surface elements comprises a combination of at least two different types of surface elements, which types comprises female surface elements and male surface elements, whereby:

a) The female surface element is provided with a female joining member on at least half of the number of its edges and a male joining member on less than half of the number of its edges.

b) The male surface element is provided with a male joining member on at least two thirds of the number of its edges and a female joining member on less than one third of the number of its edges.

c) An optional joining profile possibly constitutes a junction between two adjacent male joining members of two adjacent surface elements.

The female joining member comprises an upwards protruding lip, being parallel to the edge, with a guiding surface. The guiding surface faces the edge. The female joining member also comprises a locking groove, being parallel to the edge. The locking has a locking surface facing downwards, which locking surface terminates in a locking edge. An angle $\alpha I$ between the guiding surface and vertical plane is in the range 0–30° while an angle $\alpha II$ between the locking surface and a horizontal plane also is in the range 0–30° as seen in a perpendicular cross-section.

The male joining member comprises a groove, being parallel to the edge, on the lower side with a guiding face. The guiding face faces away from the edge. The male joining member is also provided with a locking heel, being parallel to the edge. The locking heel has a locking face facing upwards. An angle $\beta I$ between the guiding face and a vertical plane is in the range 0–30° while an angle βII between the locking face and a horizontal plane is also in the range 0–30° as seen in a perpendicular cross-section.

The possible joining profile comprises two upwards protruding rims, being parallel to each other and distanced from each other by a centre section. The two upwards protruding rims are provided with guiding areas, the guiding areas facing inwards. The joining profile is furthermore provided with two locking cheeks placed on an extension. The locking cheeks has locking areas facing downwards, which locking areas terminates in a locking edge. An angle ψI between the guiding area and a vertical plane is in the range 0–30° while an angle ψII between the locking area and a horizontal plane is in the range 0–30° as seen in a perpendicular cross-section. The angles αI and βI are mainly the same, the angles αII and βII are mainly the same and the angles ψI and ψII are mainly the same.

According to yet another embodiment of the invention the surface elements are joined by means of joining members. The edges are separated into a first and a second edge, which first and second edges are arranged on opposite sides, and a third and a fourth edge being adjacent to the first and the second edge and which third and fourth edges are arranged on sides opposite to one another. The surface elements are provided with male joining members on the first edge while the second edge of the surface elements are provided with a female joining member. The male joining member is provided with a tongue and a lower side groove, while the female joining member is provided with a groove and a cheek, the cheek being provided with a lip. The surface elements are joined together via the male and female joining members by tilting the surface element to be joined with an already installed surface element or a row of already installed floor elements, with the male joining member of the surface element angled downwards. The first edge is positioned mainly parallel to the second edge of the already installed surface element or row of surface elements. The tongue of the tilted surface element is then inserted into the groove of the female joining member of the already installed surface element or row of floor elements, whereby the tilted surface element is turned downwards, with its lower edge as a pivot axis, so that the lip eventually snaps into the lower side groove where the decorative upper layer of the surface elements are mainly parallel. The third and fourth edges of the surface elements are joined by means of joining members selected from the group consisting of;

a) The third edge of the surface elements are provided with a male vertical assembly joining member while the fourth edge is provided with a female vertical assembly joining member. The fourth edge is arranged on a side opposite to the third edge.

b) The third edge of the surface elements are alternatively provided with a male vertical assembly joining member while the fourth edge also is provided with a male vertical assembly joining member. The fourth edge is arranged on a side opposite to the third edge. The adjacent male vertical assembly joining members are joined by means of a separate vertical assembly joining profile.

Two adjacent edges of a surface element are at the same time, and in the same turning motion joined with a surface element adjacent to the first edge and a surface element adjacent to the third or fourth edge.

Particular embodiments of the invention is described further in connection to enclosed drawings whereby;

BRIEF DESCRIPTION OF THE DRAWINGS

FIG. 1 shows parts of a surface element 1. The surface elements 1 are provided with edges 2, a horizontal lower side 5, and a horizontal upper decorative surface 3. The surface elements 1 are at two adjacent edges 2 provided with lower joining lips 10 (only one shown) while the two remaining edges 2 are provided with upper joining lips 20 (only one shown). The lower joining lips 10 are provided with mainly vertical lower lip surfaces 11 arranged parallel to the closest edge 2. The lower lip surfaces 11 are intended to interact with mainly vertical upper lip surfaces 21 arranged on the upper joining lips 20 so that two joined adjacent surface elements 1 are locked together in a vertical direction. The joining lips 10 and 20 respectively are furthermore provided with each one heel 31 with a matching recess 32. A vertical movement between two joined adjacent surface elements 1 is limited since the recess 32 and heel 31 respectively are provided with essentially horizontal locking surfaces. The joining surfaces are also provided with fitting surfaces $\mathbf{3}^{I}$ in order to avoid unintended gaps in the joint. The geometry of the joining edges are only shown schematically and may, of course, be changed in many ways within the scope of the invention.

FIG. 2*a* shows, in cross-section, a first and a second edge $\mathbf{2}^{I}$ and $\mathbf{2}^{II}$ respectively, during assembly. The figure shows parts of surface elements 1 with a mainly rectangular shape. The surface elements 1 are provided with edges 2, a lower side 5 and an upper decorative layer 3. The surface elements 1 are intended to be joined by means of joining members 200. The surface elements 1 are provided with male joining members 220 on a first edge $\mathbf{2}^{I}$ while a second edge $\mathbf{2}^{II}$ of the floor elements 1 are provided with a female joining member 210. The second edge $\mathbf{2}^{II}$ is arranged on a side opposite to the first edge $\mathbf{2}^{I}$. The male joining member 220 is provided with a tongue 110 and a lower side 5 groove 12. The female joining member 210 is provided with a groove 13 and a cheek 14, the cheek 14 being provided with a lip 15. The surface elements 1 are intended to mainly be joined together by tilting the surface elements 1 to be joined with an already installed surface elements 1 or a row of already installed surface elements 1, with the male joining member 220 of the surface elements 1 angled downwards and that the first edge $\mathbf{2}^{I}$ is allowed to be mainly parallel to the second edge $\mathbf{2}^{II}$ of the already installed surface element 1 or elements 1. The tongue 110 of the tilted surface element 1 is then inserted into the groove 13 of the female joining member 210 of the already installed surface element 1 or elements 1, whereby the tilted surface element 1 is turned downwards, with its lower edge 2 as a pivot axis, so that the lip 15 eventually falls into the lower side 5 groove 12 where the decorative upper layer 3 of the surface elements 1 are mainly parallel. The lip 15 and lower side 5 groove 12 are further provided with a cam 16 and a cam groove 17 which provides a snap action locking during the turning motion.

FIG. 2*b* shows, in cross-section, a third and a fourth edge $\mathbf{2}^{III}$ and $\mathbf{2}^{IV}$ respectively, of a surface element 1 according to the invention. The surface elements 1 are provided with a male vertical assembly joining member $\mathbf{220}^{I}$ on a third edge $\mathbf{2}^{III}$ while a fourth edge $\mathbf{2}^{IV}$ is provided with a female vertical assembly joining member $\mathbf{210}^{II}$. The fourth edge $\mathbf{2}^{IV}$ is placed on a side opposite to the third edge $2^{III}$. The male vertical assembly joining members $220^{I}$ are provided with mainly vertical lower cheek surfaces 21 arranged parallel to the closest edge 2. The lower cheek surfaces $21^{I}$ are intended to interact with mainly vertical upper cheek surfaces $22^{II}$ arranged on the female vertical assembly joining members $210^{II}$ so that two joined adjacent surface elements 1 are locked against each other in a horizontal direction. The male vertical assembly joining members $220^{II}$ are moreover provided with two snapping hooks $23^{I}$ while the female vertical assembly joining members $210^{II}$ are provided with matching under cuts $24^{II}$, which by being provided with mainly horizontal locking surfaces limits the vertical movement between two joined adjacent surface elements 1.

The joint between a third and a fourth edge $2^{III}$ and $2^{IV}$ respectively of two joined surface elements 1 further comprises contact surfaces which are constituted by the mainly horizontal locking surfaces of the under cut $23^{I}$ and hook $24^{II}$, the mainly vertical upper cheek surfaces $22^{II}$ lower cheek surfaces 21as well as upper mating surfaces 25. The joint between two joined surface elements 1 also comprises cavities 60.

Figure 1:
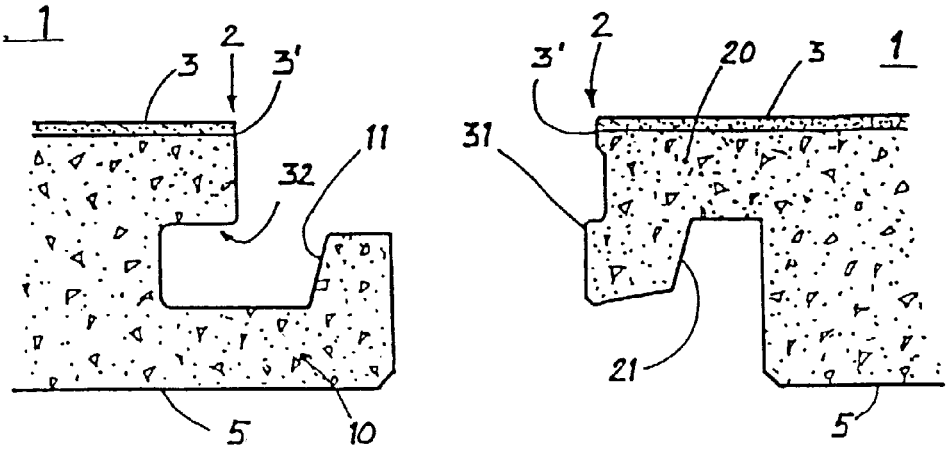
FIG. 1 shows a part of a surface element 1 according to a first embodiment of the invention.
Figure 2A:
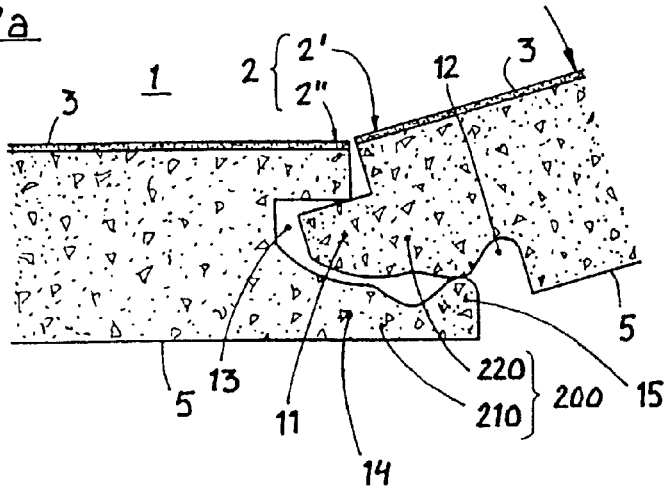
FIGS. 2*a–b* show a part of a surface element 1 according to a second embodiment of the invention.
Figure 2B:
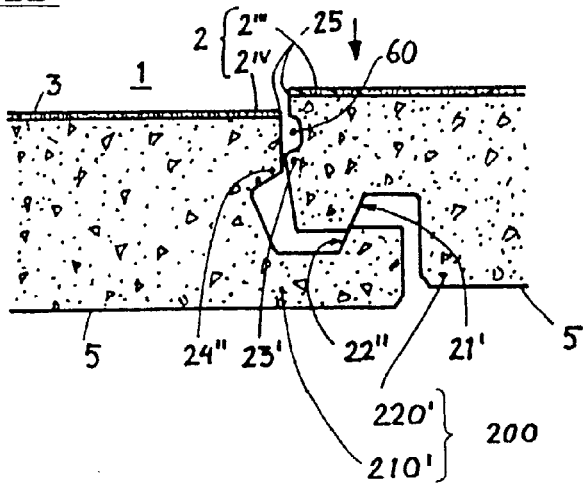
Figure 3A:
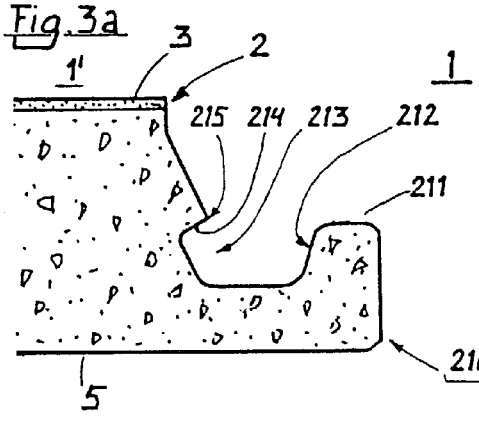
FIGS. 3*a–f* show a part of a surface element 1 according to a third embodiment of the invention.
Figure 3C:
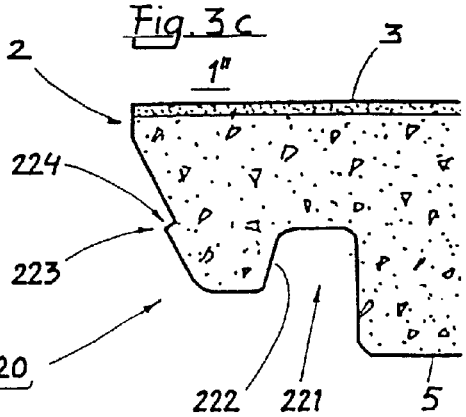
Figure 3B:
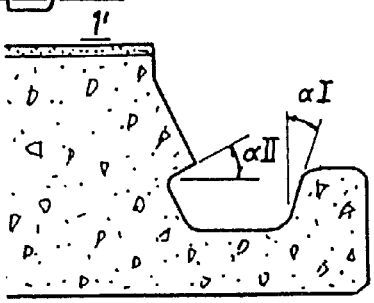

FIGS. 3*a,* 3*b,* 3*c* and 3*d* show in exploded view and in cross-section an embodiment of joining members 210 and 220 respectively to surface elements 1 according to the invention, before the assembly. The surface elements 1, which are assembled vertically, has a rectangular shape, as seen from above. The surface elements 1 are provided with edges 2 which are provided with joining members 200. The surface elements 1 are further provided with a lower side 5 and a decorative top surface 3. The surface elements 1 comprises a combination of at least two types of surface elements 1, which types comprises female surface elements $1^{I}$ and male surface elements $1^{II}$.

The female surface elements $1^{I}$ is provided with a female joining member 210 on at least half of the number of its edges 2 and a male joining member 220 on less than half of the number of its edges 2. The female joining member 210 comprises an upwards protruding lip 211, being parallel to the edge 2. The upwards protruding lip 211 is provided with a with a guiding surface 212, the guiding surface 212 facing the edge 2, and a locking groove 213, being parallel to the edge 2. The locking groove 213 has a locking surface 214 facing downwards, which locking surface 214 terminates in a locking edge 215. An angle αI between the guiding surface 212 and a vertical plane is 10°, while the angle αII between the locking surface 214 and a horizontal plane is 15° as seen in a perpendicular cross-section.

The male surface elements $1^{II}$ is provided with a male joining member 220 on at least two thirds of the number of its edges 2 and a female joining member 210 on less than one third of the number of its edges 2.

The male joining member 220 comprises a groove 221, with a guiding face 222, being parallel to the edge 2, on the lower side 5. The guiding face 222 is facing away from the edge 2. The male joining member 220 is also provided with a locking heel 223, being parallel to the edge 2. The locking heel 223 has a locking face 224 facing upwards. An angle βI between the guiding face 222 and vertical plane is 10°, while an angle βII between the locking face 224 and a horizontal plane is 15° as seen in a perpendicular cross-section.

Accordingly, the angles αI and βI are the same and the angles αII and βII are also the same.

An optional joining profile 50 (see FIGS. 3*e* and 3*f*) may possibly constitute a junction between two adjacent male joining members 220 of two adjacent surface elements 1.

The section placed between the edges 2 and the grooves 221 has a thickness which is less than the maximum surface element thickness by a recess 6 on the lower side 5 of the surface elements 1. The thickness of the surface elements 1 is normally between 5 and 15 mm whereby a suitable depth of the recess 6 is 1–5 mm.

The width of the locking face 224 is depending on aspects like the thickness of the surface element 1, the material used in the core, the dimensions of the part between the locking groove 213 and the lower side 5 and the angles αI and βI chosen. The width of the locking face 224 is typically less than 30% of the thickness of the surface element which normally is between 5 and 15 mm whereby the width is less than 4.5 mm for floors with 15 mm thickness and 2.1 mm for a common surface element with a thickness of 7 mm. It has, however shown to be fully sufficient with a width between 0.2 mm and 1 mm.

Figure 3D:
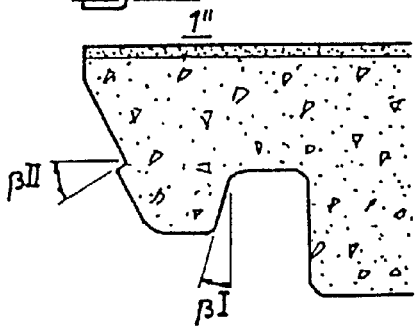
Figure 3E:
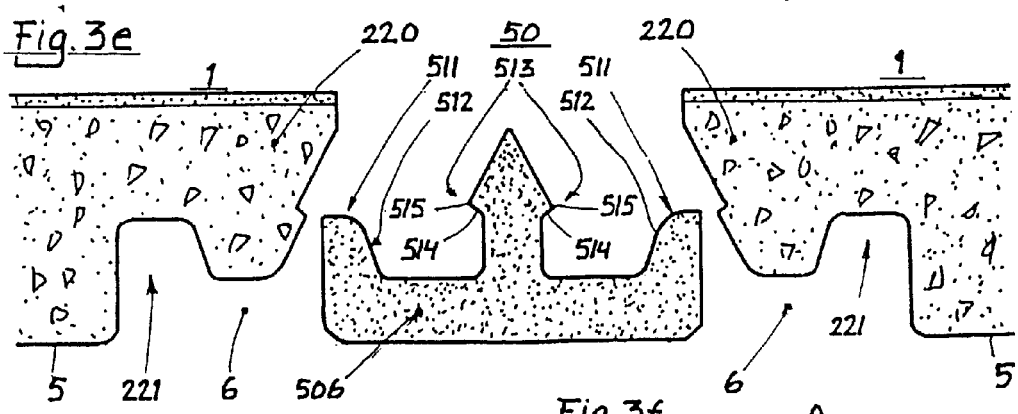
Figure 3F:
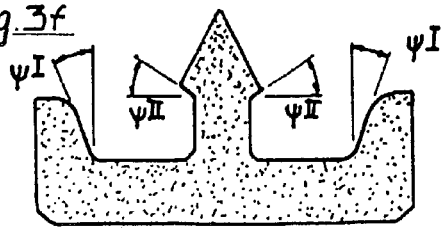

FIG. 3*e* and 3*f* show, in cross-section, an embodiment of a joining profile 50 to a surface element 1 according to the invention. The joining profile 50 is intended to be used as a junction between two male joining members 220. The joining profile 50 comprises two upwards protruding rims 511, being parallel to each other and distanced from each other by a centre section 506. The two upwards protruding rims 511 are provided with guiding areas 512. The guiding areas 512 are facing inwards. The joining profile 50 is furthermore provided with two locking cheeks 513 placed on an extension 507. The locking cheeks 513 has locking areas 514 facing downwards, which locking areas 514 terminates in a locking edge 515. An angle ψI between the guiding area 512 and the vertical plane is 10° and the angle ψII between the locking area 514 and a horizontal plane is 15° as seen in a perpendicular cross-section.

Accordingly, the angles αI, βI (FIGS. 3*a*–3*d*) ψI and are the same and the angles αII, βII (FIG. 3*a*14 3*d*) are also the same.

The invention is not limited by the embodiments shown since these can varied in different ways within the scope of the invention.

The invention claimed is:

1. A process for the installation of surface elements, the surface elements comprising a core, a decorative upper surface and edges provided with joining means for mechanically locking the surface elements together, the joining forming a gap between the upper surfaces of the surface elements at a joint, wherein predetermined portions of the edges are provided with a glue which is present on the edges of the surface elements in a passive dry form, whereby the surface elements are joined to each other by use of the joining means wherein a unit of a plurality of surface elements is formed wherein a thin coat of a liquid is applied on the upper surface of the installed surface elements wherein small amounts of the liquid will penetrate into the gap between the elements and into the joint thereby moisturising and activating the glue whereby the glue will expand and merge over the edges of the joint and will act as sealant against further penetration of liquid.

2. A process according to claim 1, wherein the glue is a PVA glue.

3. A process according to claim 2, wherein the glue is applied on the edges as an emulsion which then is allowed to dry before the joining of the surface elements.

4. A process according to claim 1, wherein the liquid is water.

5. A process according to claim 1, wherein the liquid is a mixture of water and alcohol.

6. A process for the installation of surface elements, the surface elements comprising a core, a decorative upper surface and edges provided with joining means for mechanically locking the surface elements together, the joining forming a gap between the upper surfaces of the surface elements at a joint, wherein predetermined portions of the edges are provided with a glue which is present on the edges of the surface elements in a passive dry form, whereby the surface elements are joined to each other by use of the joining means wherein a unit of a plurality of surface elements is formed wherein small amounts of liquid accidently spilt are applied on the upper surface of the installed surface elements wherein small amounts of the liquid will penetrate into the gap between the elements and into the joint thereby moisturising and activating the glue whereby the glue will expand and merge over the edges of the joint and will act as sealant against further penetration of liquid.

7. A process according to claim 1, wherein the joining means comprises lower joining lips at two adjacent edges while the two remaining edges are provided with upper joining lips, whereas the lower joining lips are provided with intrinsically vertical lower lip surfaces arranged parallel to the closest edge, the lower lip surfaces being adapted to interact with mainly vertical upper lip surfaces arranged on the upper joining lips so that two joined adjacent surface elements are locked together in a horizontal direction and that the joining lips furthermore are provided with at least one heel adapted to snap join with recesses which, by being provided with intrinsically horizontal locking surfaces, limits vertical movement between two joined adjacent surface elements , whereby surface elements are assembled by being pressed downwards once the edges are vertically aligned.

8. A process for installation of surface elements, according to claim 6, wherein the surface elements comprise a core, a decorative upper surface and edges provided with joining means for mechanically locking the surface elements together wherein predetermined portions of the edges are provided with a glue which is present on the edges of the surface elements in a passive dry form, whereby the surface elements are joined to each other by use of the joining means wherein a unit of a plurality of surface elements is formed wherein the surface elements comprise a combination of at least two different types of surface elements, which types comprises female surface elements and male surface elements, whereby, i. the female surface element is provided with a female joining member on at least half of the number of its edges and a male joining member on less than half of the number of its edges and that, ii. the male surface element is provided with a male joining member on at least two thirds of the number of its edges and a female joining member on less than one third of the number of its edges.

9. A process according to claim 1, wherein the surface elements are joined by means of joining members, the edges being separated into a first and a second edge, which first and second edges are arranged on opposite sides, and a third and a fourth edge being adjacent to the first and the second edge and which third and fourth edges are arranged on sides opposite to one another, whereby the surface elements are provided with male joining members on the first edge while the second edge of the surface elements are provided with a female joining member, that the male joining member is provided with a tongue and a lower side groove, while the female joining member is provided with a groove and a cheek, the cheek being provided with a lip, whereby the surface elements are joined together via the male and female joining members by tilting the surface element or a row of already installed floor elements, with the male joining member of the surface element angled downwards, that the first edge is positioned mainly parallel to the second edge of the already installed surface element or row of surface elements, whereupon the tongue of the tilted surface element is inserted in to the groove of the female joining member of the already installed surface element is turned downwards, with its lower edge as a pivot axis, so that the lip eventually snaps into the lower side groove where the decorative upper layer of the surface elements are mainly parallel, and that the third and fourth edges of the surface elements are joined by means of joining members selected from the group consisting of;

iii. wherein the surface elements, on the third edge, are provided with a male vertical assembly joining member while the fourth edge is provided with a female vertical assembly joining member, the fourth edge being arranged on a side opposite to the third edge, and, iv. wherein the surface elements on the third edge, are provided with a male vertical assembly joining member while the fourth edge also is provided with a male vertical assembly joining member, the fourth edge, being arranged on a side opposite to the third edge, which adjacent male vertical assembly joining members are joined by means of a separate vertical assembly joining profile, whereby two adjacent edges of a surface element at the same time, and in the same turning motion is joined with a surface element adjacent to the first edge and a surface element adjacent to the third or fourth edge.

* * * * *